US009796463B2

(12) United States Patent
Ulgen

(10) Patent No.: US 9,796,463 B2
(45) Date of Patent: Oct. 24, 2017

(54) DEVICE FOR CHANGING PROPELLER POSITION

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 209 days.

(21) Appl. No.: 14/974,735

(22) Filed: Dec. 18, 2015

(65) Prior Publication Data

US 2017/0106955 A1 Apr. 20, 2017

(30) Foreign Application Priority Data

Oct. 16, 2015 (TR) ..... a 2015 12900

(51) Int. Cl.
*B63H 5/125* (2006.01)
*B63H 1/14* (2006.01)
*B63H 25/42* (2006.01)

(52) U.S. Cl.
CPC ..... *B63H 5/125* (2013.01); *B63H 1/14* (2013.01); *B63H 25/42* (2013.01)

(58) Field of Classification Search
CPC ..... B63H 5/125; B63H 25/42; B63H 1/14; B63H 2025/425
See application file for complete search history.

(56) References Cited

U.S. PATENT DOCUMENTS 3,589,204 A * 6/1971 Langley ..... B63H 20/10 440/59
3,933,116 A * 1/1976 Adams ..... B63H 5/1252 440/112
4,544,362 A * 10/1985 Arneson ..... B63H 5/125 440/112
4,929,203 A * 5/1990 Hahn ..... B63H 5/1252 410/51
5,326,294 A * 7/1994 Schoell ..... B63H 5/08 440/57
5,931,710 A * 8/1999 Johnson, Sr. ..... B63H 5/125 440/55
6,908,350 B1 * 6/2005 Roessler ..... B63H 1/18 440/61 R
7,503,818 B1 * 3/2009 Hagan ..... B63H 5/10 440/61 T
8,376,792 B2 * 2/2013 Chiecchi ..... B63H 5/125 440/53
2009/0053944 A1 * 2/2009 Hagan ..... B63H 5/10 440/75
2010/0221964 A1 * 9/2010 Snow ..... B63H 25/42 440/57

* cited by examiner

*Primary Examiner* — Gregory Anderson
*Assistant Examiner* — Eldon Brockman
(74) *Attorney, Agent, or Firm* — Vidas, Arrett & Steinkraus, P.A.

(57) ABSTRACT

A propeller position changing device which is capable of changing position according to cruise conditions of a vessel of a floating type.

11 Claims, 10 Drawing Sheets

DEVICE FOR CHANGING PROPELLER POSITION

TECHNICAL FIELD

The present invention relates to a device for changing propeller position according to cruise conditions of a watercraft.

BACKGROUND OF INVENTION

The drive force required for the motion of floating vessels is provided by propellers equipped with various driving mechanisms. In shaft drive vessels, shafts are generally communicated to the inboard motor so as to make an angle of about 10° downward from the water surface. While propeller performance in shaft drive vessels is high up to speed levels of 30-40 knots of the vessel, it decreases in speed levels of 50-60 knots due to the increasing need for motor power. Especially at high speeds, surface drive propellers may be preferred for increasing propeller performance. In such propellers, the propeller shaft extends linearly backward from the boat transom, some of the propeller blades remaining under water level, while some remaining on the water surface. The vessel is thus provided with drive force by a propeller operated by a lower motor power since the propeller device and some of the blades are not subject to water resistance.

It has been aimed to increase propeller performance by partly moving some known surface drive propellers in vertical direction. For example, U.S. Pat. No. 5,279,509 discloses a surface drive propeller device which can perform up and down swinging movement with the steering mechanism thereof. Swing of the propeller is essentially provided by changing the rotational axis of the shaft, which extends from the boat transom, by means of a universal joint. U.S. Pat. No. 5,279,509 cannot provide the efficiency provided by a conventional shaft drive propeller at low boat speeds since the propeller blades still remain above the water level during maximum downward inclination of the shaft. Moreover, although propeller blades could totally remain under water level, it is not possible, by using a power transmission means based on a sole universal joint, to achieve transmission of the motor torque to the propeller in order for the propeller to provide sufficient drive force.

Apart from shaft drive and surface drive propellers, pod-drive and Z-drive propellers are also used in the art, but these are far from achieving optimum propeller performance according to changing cruise conditions.

Thus, there exists a need for a propeller device which serves as a shaft drive propeller at relatively lower speeds of the vessel or during the compensation of starting inertia, or in conditions where water resistance on the hull is relatively lower, while acting like a surface drive propeller at relatively higher boat speeds.

BRIEF DESCRIPTION OF INVENTION

An object of the invention is to provide a propeller device achieving an efficient propeller performance according to cruise conditions of the vessel.

In order to achieve the objective, the present invention relates to a propeller position changing device comprising a first shaft communicating with a motor from a first end thereof, a second shaft communicating with a second end of the first shaft wherein the second shaft is rotatable about the axis of the first shaft or an axis separate from axis of the first shaft, a motion transmission means communicating the first shaft to the second shaft, a first piston rotating the second shaft relative to the first shaft, a propeller communicating with the second shaft from a second end thereof, characterized by comprising a first conical gear provided to the second end of the first shaft, a second conical gear provided to the first end of the second shaft, a third conical gear transmitting motion between said conical gears, a first sleeve comprising a first sleeve groove through which the second shaft is moved for making a relative motion thereof, a first sleeve hole for rotatable communication of the first shaft, a first ring receiving the first conical gear, the second conical gear and the third conical gear, and comprising a first ring groove through which the first shaft is moved for making a relative motion thereof, a first ring hole for rotatable communication of the second shaft.

According to an embodiment of the invention, the propeller comprises a third shaft communicating with the second shaft. The communication of the third shaft to the second shaft is similar to that of the second shaft to the first shaft. In such an embodiment, the propeller communicates with the third shaft. An advantage of this embodiment is to ensure that the propeller hub axis remains parallel to the water surface in any case.

According to an embodiment, the invention comprises an arrangement which allows the propeller to oscillate horizontally at a certain vertical distance, and thus serving as a rudder mechanism for the boats with no rudder.

Figure 1:
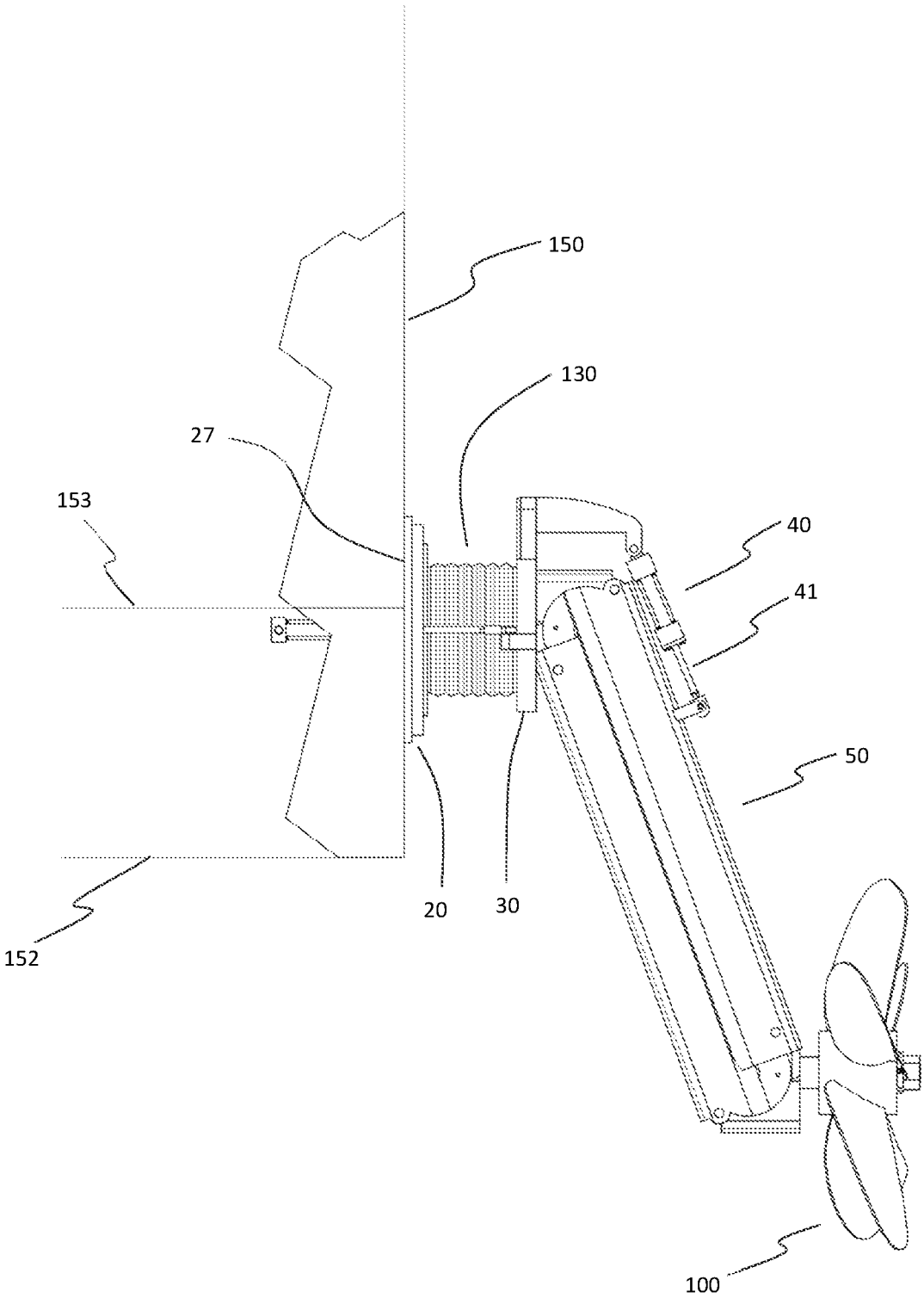
FIG. 1 is a side view of the device according to the invention at a position lower than water surface.

| PART NUMERALS | |
|---|---|
| 10 | First shaft |
| 20 | Transom fixing plate |
| 21 | Transom fixing plate connection holes |
| 22 | Transom fixing plate piston connection holes |
| 23 | Transom fixing plate first lug |
| 24 | Transom fixing plate second lug |
| 25 | Transom fixing plate first pin holes |
| 26 | Transom fixing plate second pin holes |
| 27 | Transom leaning surface |
| 30 | Piston support |
| 31 | Piston support arm |

-continued

| PART NUMERALS | |
|---|---|
| 32 | Piston support connection holes |
| 33 | Piston support shaft hole |
| 34 | First piston connection protrusion |
| 35 | Second piston connection protrusion |
| 36 | Piston support first lug pair |
| 37 | Piston support second lug pair |
| 38 | Piston support first pin holes |
| 39 | Piston support second pin holes |
| 40 | First piston |
| 41 | First piston arm |
| 42 | First piston connecting piece |
| 43 | First piston joint |
| 50 | Housing |
| 51 | Upper housing portion |
| 52 | Lower housing portion |
| 53 | Upper housing upper surface |
| 54 | Upper housing lateral surfaces |
| 55 | Lower housing upper surface |
| 56 | Lower housing lateral surfaces |
| 57.1 | Upper housing first connection holes |
| 57.2 | Upper housing second connection holes |
| 58.1 | Lower housing first connection holes |
| 58.2 | Lower housing second connection holes |
| 59.1 | Upper housing connection channel |
| 59.2 | Lower housing connection protrusion |
| 60 | First sleeve |
| 61 | First sleeve space |
| 62 | First conical gear |
| 63 | Second conical gear |
| 64 | Third conical gear |
| 65 | Fourth conical gear |
| 66 | First sleeve groove |
| 67 | First sleeve hole |
| 68.1 | First sleeve first connection hole |
| 68.2 | First sleeve second connection hole |
| 69 | First sleeve lateral surface |
| 70 | Third conical connecting shaft |
| 71 | First sleeve O-rings |
| 72 | First sleeve upper cap |
| 73 | First sleeve lower cap |
| 74 | Upper cap bearing |
| 75 | Lower cap bearing |
| 76 | Housing first connecting pin |
| 77 | Housing second connecting pin |
| 78.1 | First shaft bearing |
| 78.2 | First shaft gasket |
| 79.1 | Second shaft first bearing |
| 79.2 | Second shaft first gasket |
| 80 | First ring |
| 81 | First ring space |
| 82 | First ring groove |
| 83 | First ring hole |
| 85 | First ring lateral surface |
| 60 | Second sleeve |
| 61' | Second sleeve space |
| 62' | Fifth conical gear |
| 63' | Sixth conical gear |
| 64' | Seventh conical gear |
| 65' | Eighth conical gear |
| 66' | Second sleeve groove |
| 67' | Second sleeve hole |
| 68'.1 | Second sleeve first connection hole |
| 68'.2 | Second sleeve second connection hole |
| 69' | Second sleeve lateral surface |
| 70' | Seventh conical connecting shaft |
| 71' | Second sleeve O-rings |
| 72' | Second sleeve upper cap |
| 73' | Second sleeve lower cap |
| 74' | Upper cap bearing |
| 75' | Lower cap bearing |
| 76' | Housing first connecting pin |
| 77' | Housing second connecting pin |
| 78'.1 | Second shaft second bearing |
| 78'.2 | Second shaft second gasket |
| 79'.1 | Third shaft bearing |
| 79'.2 | Third shaft gasket |
| 80' | Second ring |

-continued

| PART NUMERALS | |
|---|---|
| 81' | Second ring space |
| 82' | Second ring groove |
| 83' | Second ring hole |
| 85' | Second ring lateral surface |
| 100 | Propeller |
| 101 | Third shaft |
| 102 | Shaft fixing nut |
| 110 | Second piston |
| 111 | Second piston connecting end |
| 112 | Second piston arm |
| 120 | Third piston |
| 121 | Third piston connecting end |
| 122 | Third piston arm |
| 130 | Bellows |
| 140 | Second shaft |
| 150 | Transom |
| 151 | Transom vertical axis |
| 152 | Boat bottom |
| 153 | Water surface line |

DETAILED DESCRIPTION OF INVENTION

The term "vessel" as used herein refers to any vessel of floating type, and also the term "boat" can be used instead of "vessel" in some instances.

The device according to the invention is mounted to the transom of a vessel which comprises an inboard motor (not shown) and a first shaft (10) driven thereby. In order for the drawings not to be complicated, a single device mounted in the transom (150) is illustrated; however, according to the preferred embodiment of the invention, two devices mounted symmetrically to transom vertical axis (151) are used. When only one device according to the invention is to be used, it is mounted such that it will be on the transom vertical axis (151).

The first shaft (10) preferably has a cardan coupling. The device preferably comprises a disc-shaped transom fixing plate (20) in order for the device to be mounted in the vessel. The transom fixing plate (20) leans against the boat transom over the transom leaning surface (27) and is fixed by means of bolts passed through a number of connection holes (21) provided along the circumference of the outer diameter of the transom fixing plate (20).

The first shaft (10) attached to the vessel motor passes through a hole formed at the center of transom fixing plate (20) and extends towards the rear of the vessel. Here, for the sake of clarity in the drawings, the portion of the first shaft (10) which remains in front of the transom fixing plate (20) is not shown.

A piston support (30) which is located coaxially at a distance from the transom fixing plate (20) and which is preferably disc-shaped communicates with said transom fixing plate (20), the details of which will be described later. The space remaining between the transom fixing plate (20) and the piston support (30) is closed by means of a cylindrical bellows (130), which is attached to these parts from the two ends thereof. There exists a piston support shaft hole (33) where the first shaft (10) is rotatably embedded at the center of the piston support (30). The first shaft (10) proceeding from the piston support (30) is introduced into the first sleeve (60). The first sleeve (60) has a cylindrical first sleeve space (61) and a cylindrical first ring (80) is seated rotatably in said first sleeve space (61). The end of the first shaft (10) extends to the internal space of the ring (80).

Provided at the end of the first shaft (10) is a first conical gear (62). The first conical gear (62) can be attached to the end of the first shaft (10) integrally or by means of key coupling to the first shaft (10), the latter being easier to mount in terms of construction. The first conical gear (62) communicates with a third conical gear (64) having a perpendicular axis related thereto, along a certain segment. Said third conical gear (64), on the other hand, communicates with a second conical gear (63) having a perpendicular axis related thereto, along another segment. Said second conical gear (63) is disposed at an end of a second shaft (140). The third conical gear (64) is rotatably embedded in the first sleeve upper cap (72) and the first sleeve lower cap (73), which are positioned reciprocally, by means of a connecting shaft (70) passing from the center thereof, over a respective upper cap bearing (74) and a lower cap bearing (75). The first sleeve (60) is formed watertight by means of circular first sleeve O-rings (71) provided in the internal surfaces of the first sleeve upper cap (72) and/or the first sleeve lower cap (73).

According to the preferred embodiment of the invention, there exists a fourth conical gear (65) which faces the third conical gear (64) axially and communicates with the first conical gear (62) and with the second conical gear (63).

A first sleeve hole (67) is formed in the first sleeve (60) lateral surface and the first shaft (10) is rotatably embedded in this first sleeve hole (67) by way of the first shaft bearing (78.1) and the first shaft gasket (78.2). A first ring groove (82) formed in the lateral surface (85) of the first ring (80) corresponds to the end of the first sleeve hole (67) opening into the sleeve. Said first ring groove (82) has a flat, ellipse-like geometry. The first shaft (10) passes through the first ring groove (82) and the first conical gear (62) at the end thereof remains inside the first ring space (81). The first shaft (10) can be guided in the first ring groove (82) and moved along the groove (82).

Again, a flat, ellipse-like first sleeve groove (66) is provided in the opposite lateral surface of the first sleeve (60). A first ring hole (83) formed in another lateral surface (85) of the first ring (80) corresponds to the end of said first sleeve groove (66) opening into the sleeve. The second shaft (140) is rotatably embedded in the first ring hole (83) over a second shaft bearing (79.1) and a first shaft gasket (79.2) and advances by passing through the first sleeve groove (66). In this case, the second conical gear (63) at the end of the second shaft (140) remains inside the first ring space (81). The second shaft (140) can be guided in the first sleeve groove (66) and moved along the groove (66).

Although not shown in figures, a propeller is fixed to the other end of the second shaft as known in the art.

According to an embodiment of the invention, a third shaft (101) is placed between the propeller (100) and the second shaft (140) while a second sleeve (60') is placed between said third shaft (101) and said second shaft (140). The second sleeve (60') is basically identical to the first sleeve (60) in terms of structure, but its orientation is different from that of the first sleeve (60).

According to this embodiment, a fifth conical gear (62') is disposed at the other end of the second shaft (140) that is close to the propeller (i.e. second end). Again, the fifth conical gear (62') can be attached to the end of the second shaft (140) integrally or by means of key coupling. The fifth conical gear (62') communicates with a seventh conical gear (64') having a perpendicular axis related to the axis of said conical gear (62'), along a certain segment. Said seventh conical gear (64'), on the other hand, communicates with a sixth conical gear (63') having a perpendicular axis related thereto, along another segment. Said sixth conical gear (63') is disposed at an end of a third shaft (101). The seventh conical gear (64') is rotatably embedded in the second sleeve upper cap (72') and the second sleeve lower cap (73'), which are positioned reciprocally, by means of a connecting shaft (70') passing from the center thereof, over a respective upper cap bearing (74') and a lower cap bearing (75'). The second sleeve (60') is formed watertight by means of circular second sleeve O-rings (71') provided in the internal surfaces of the second sleeve upper cap (72') and/or the second sleeve lower cap (73').

According to the preferred embodiment of the invention, there exists an eighth conical gear (65') which faces the seventh conical gear (64') axially and communicates with the fifth conical gear (62') and with the sixth conical gear (63').

A second sleeve hole (67') is formed in the second sleeve (60') lateral surface and the third shaft (101) is rotatably embedded in this second sleeve hole (67') by way of the third shaft bearing (79'.1) and the third shaft gasket (79'.2). A second ring groove (82') formed in the lateral surface (85') of the second ring (80') corresponds to the end of the second sleeve hole (67') opening into the sleeve. Said second ring groove (82') has a flat, ellipse-like geometry. The third shaft (101) passes through the first ring groove (82) and the sixth conical gear (63') at the end thereof remains inside the second ring space (81'). The third shaft (101) can be guided in the second ring groove (82') and moved along this groove (82').

Again, a flat, ellipse-like second sleeve groove (66') is provided in the opposite lateral surface of the second sleeve (60'). A second ring hole (83') formed in another lateral surface (85') of the second ring (80') corresponds to the end of the second sleeve groove (66') opening into the sleeve. The second shaft (140), from the other end thereof, is rotatably embedded in the second ring hole (83') over a second shaft second bearing (78'.1) and a second shaft second gasket (78'.2) and advances by passing through the second sleeve groove (66'). In this case, the fifth conical gear (62') at the end of the second shaft (140) remains inside the second ring space (81'). The second shaft (140) can be guided in the second sleeve groove (66') and moved along this groove (66').

The first sleeve (60) (and if used, the second sleeve (60')) is placed into a hollow housing (50) having a longitudinal form. The housing (50) consists of an upper housing portion (51) and a lower housing portion (52). The upper housing portion (51) and the lower housing portion (52) have a U-like cross-sectional profile. Connection channels (59.1) are opened along the lower edges of the reciprocal lateral surfaces (54) of the upper housing portion (51). Connection protrusions (59.2) are formed along the lower edges of the reciprocal lateral surfaces (56) of the lower housing portion (52). Said connection protrusions (59.2) are introduced into the connection channels (59.1), thereby achieving sliding communication of the upper housing portion (51) relative to the lower housing portion (52).

At an end of the upper housing portion (51) are upper housing first connection holes (57.1) made reciprocally on the upper housing lateral surfaces (54) close to the upper surface (53) thereof, while at the other end exist upper housing second connection holes (57.2) made reciprocally in a similar position. Likewise, at an end of the lower housing portion (52) are lower housing first connection holes (58.1) made reciprocally on the lower housing lateral surfaces (56) close to the upper surface (55) thereof, while at the other end exist lower housing second connection holes (58.2) made reciprocally in a similar position.

A first sleeve first connection hole (68.1) and a first sleeve second connection hole (68.2), which are formed in parallel direction to sleeve axis, are disposed at two diagonal ends of the first sleeve (60). Subsequent to aligning the upper housing first connection holes (57.1) to the first sleeve first connection hole (68.1), a housing first connecting pin (76) is passed through these holes, and thus achieving rotatable communication of the upper housing portion (51) relative to the first sleeve (60). Subsequent to aligning the lower housing first connection holes (58.1) to the first sleeve second connection hole (68.2), a housing second connecting pin (77) is passed through these holes, and thus achieving rotatable communication of the lower housing portion (52) relative to the first sleeve (60).

In the embodiment of the device according to the invention comprising a second sleeve (60'), a configuration similar to the aforementioned one is provided. A second sleeve first connection hole (68'.1) and a second sleeve second connection hole (68'.2), which are formed in parallel direction to sleeve axis, are disposed at two diagonal ends of the second sleeve (60'). Subsequent to aligning the upper housing second connection holes (57.2) to the second sleeve first connection hole (68'.1), a housing first connecting pin (76') is passed through these holes, and thus achieving rotatable communication of the upper housing portion (51) relative to the second sleeve (60'). Subsequent to aligning the lower housing second connection holes (58.2) to the second sleeve second connection hole (68'.2), a housing second connecting pin (77') is passed through these holes, and thus achieving rotatable communication of the lower housing portion (52) relative to the second sleeve (60').

A first piston connecting piece (42) is disposed in the upper surface (53) of the upper housing portion (51). Said first piston (40) is communicated to this first piston connecting piece (42) by means of a swivel joint (43), from the end portion of the first piston arm. The first piston (40), from the other end thereof, is connected to a piston support arm (31) which protrudes from the upper portion of the piston support (30) and advances axially to some extent. Reciprocal piston support connection holes (32) with a space at the middle are disposed at the end portion of the piston support arm (31) in order to achieve said connection; and the ring provided at the end portion of the first piston (40) is passed through said space, thereby achieving rotatable connection by means of a pin.

Figure 3:
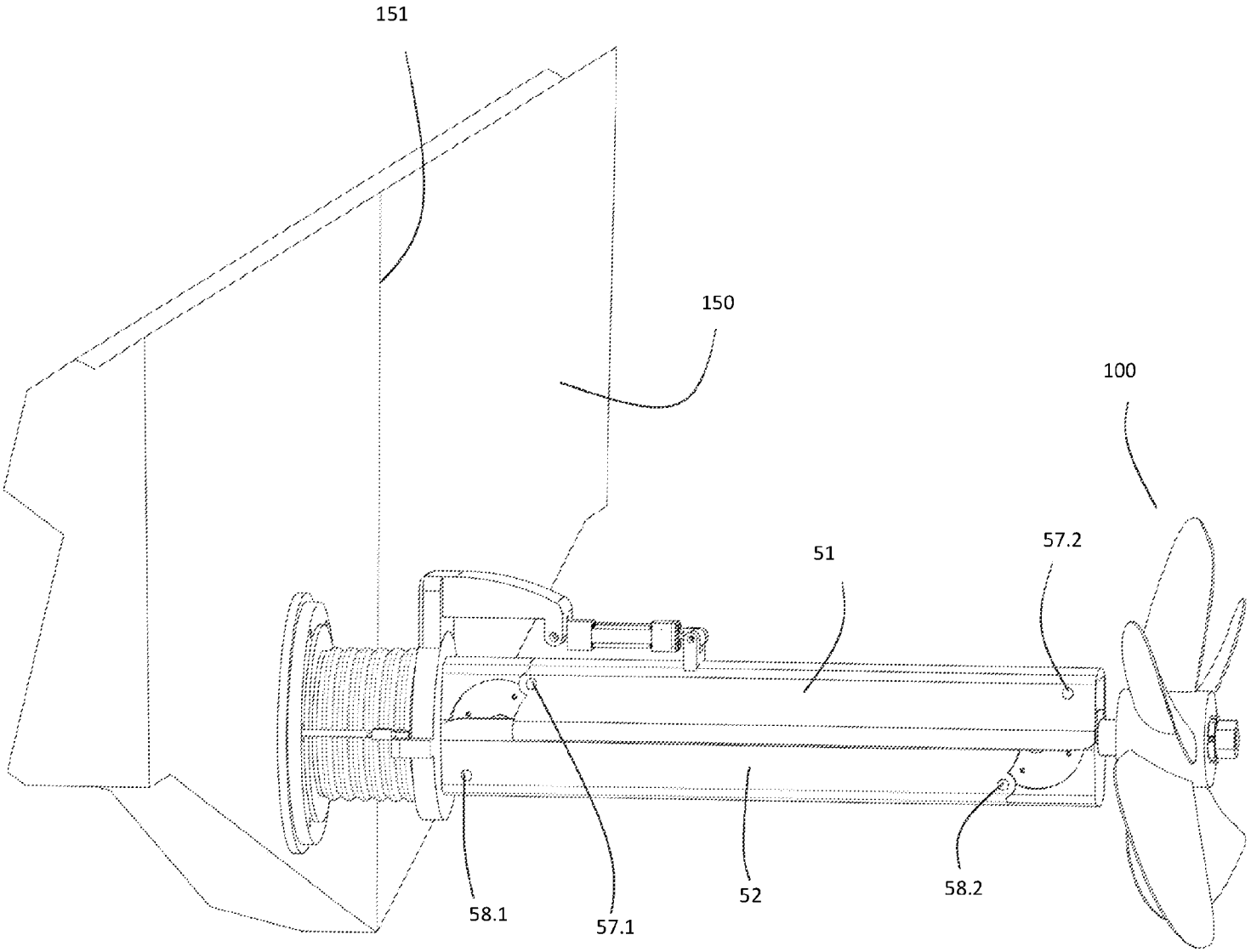
FIG. 3 is a perspective view of the device according to the invention at a position in water surface.
Figure 4:
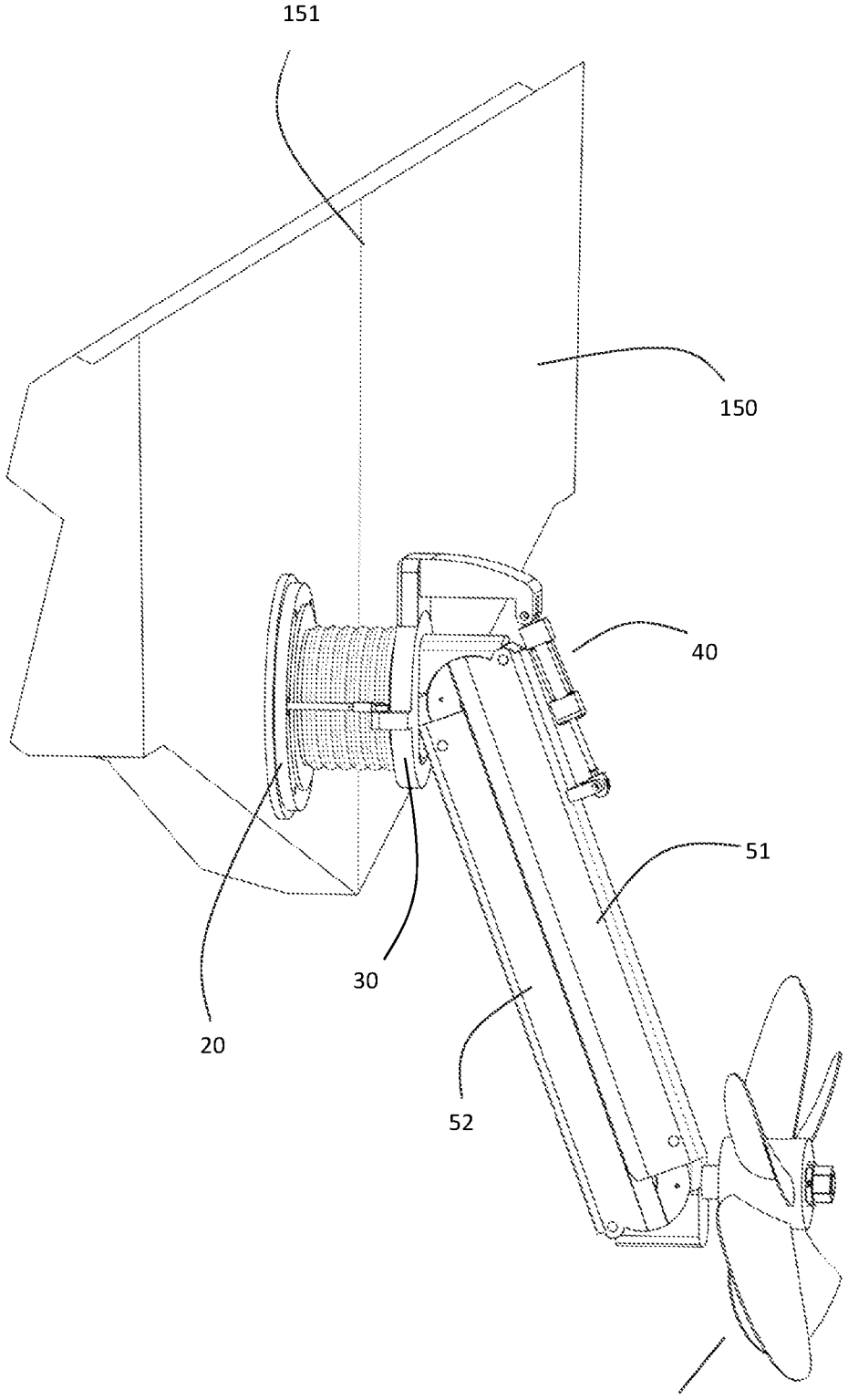
FIG. 4 is a perspective view of the device according to the invention at a position lower than water surface.
Figure 5:
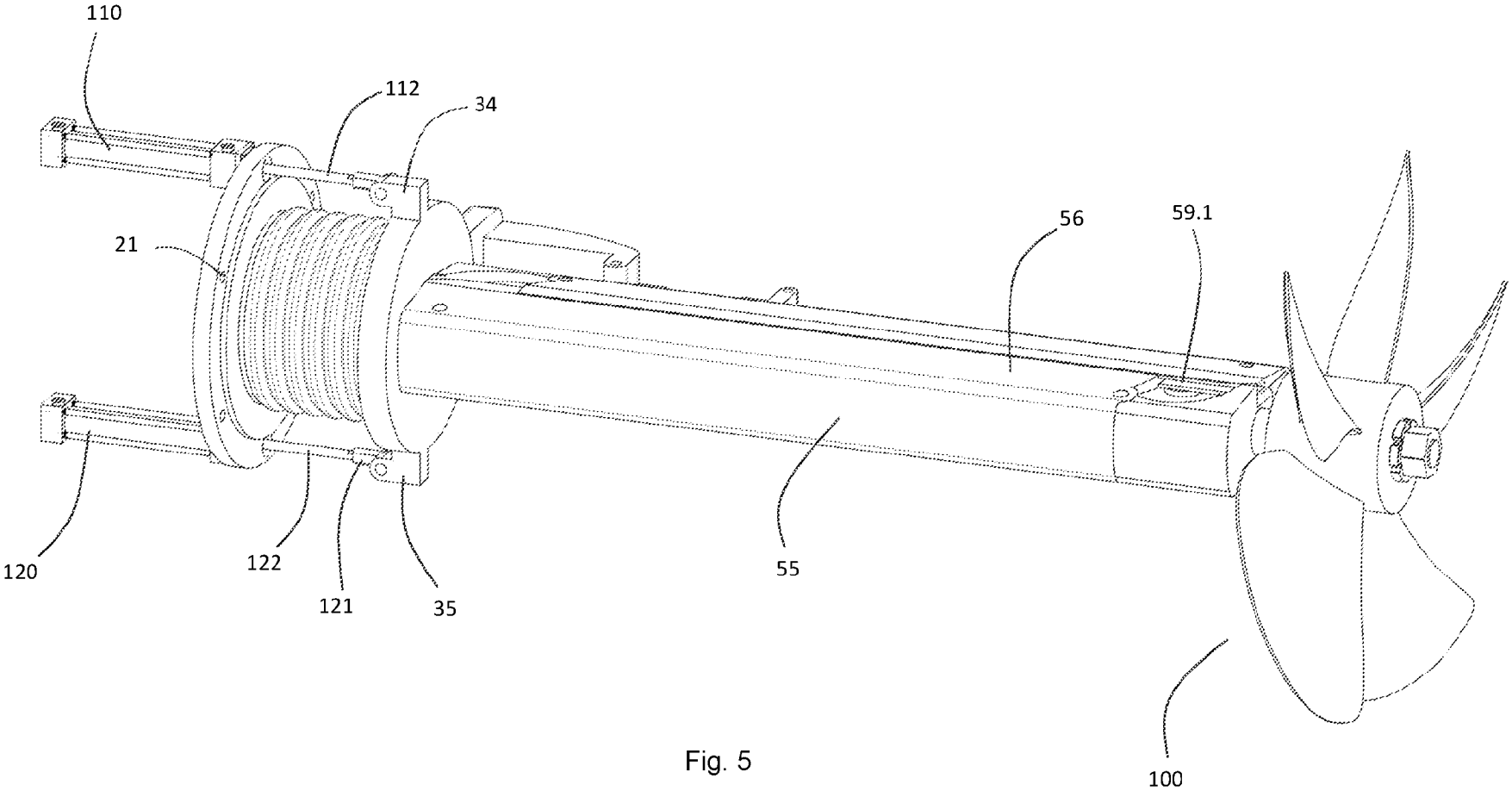
FIG. 5 is a bottom perspective view of the device according to the invention at a position in water surface.
Figure 6:
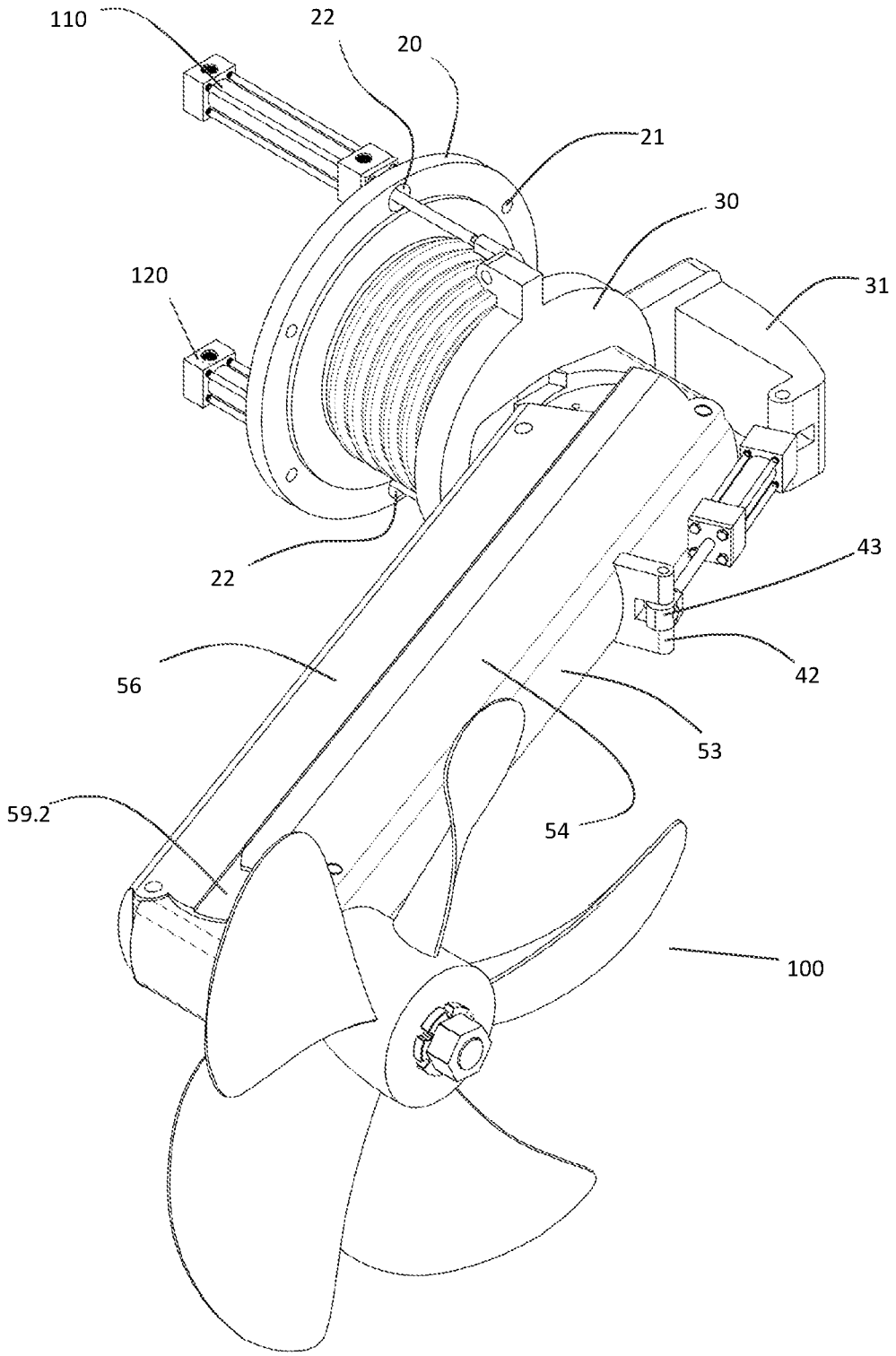
FIG. 6 is a top perspective view of the device according to the invention at a position lower than water surface.
Figure 7:
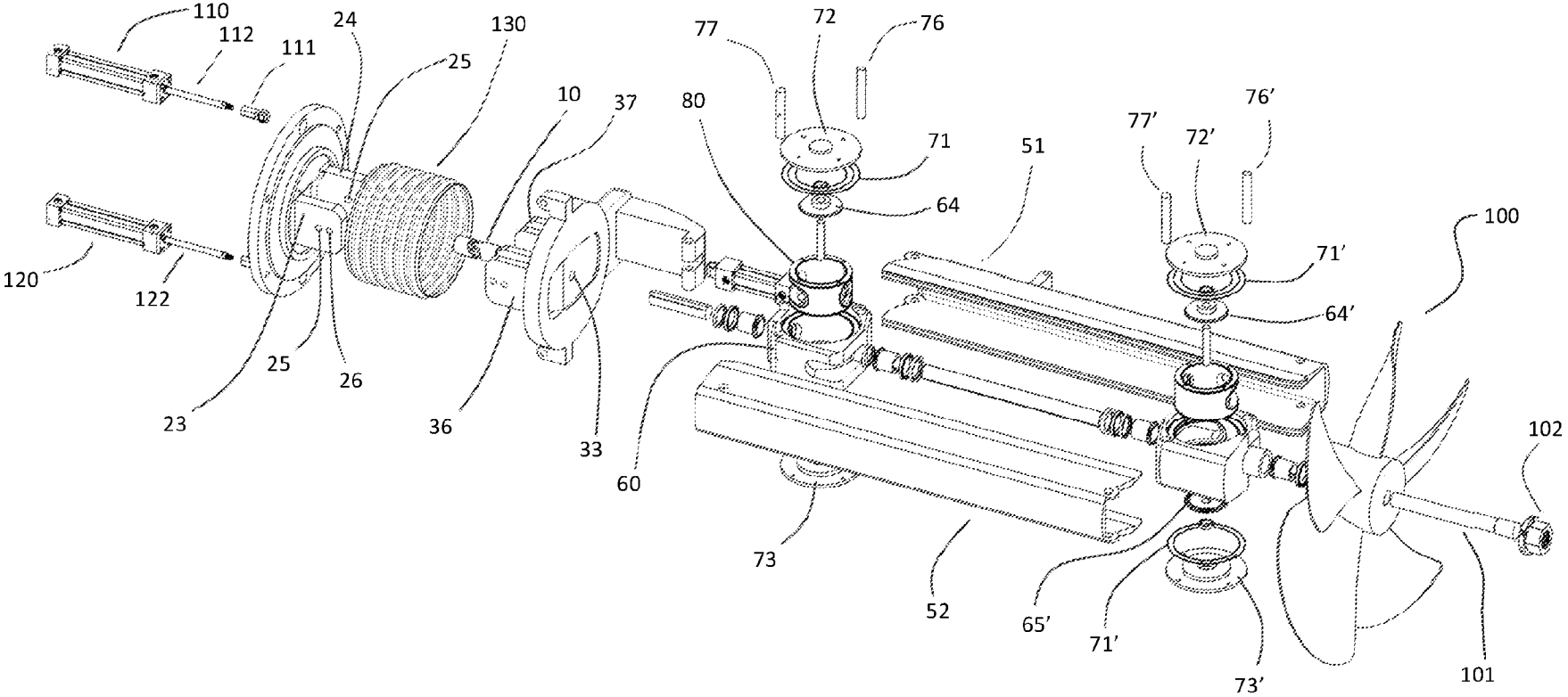
FIG. 7 is a exploded perspective view of the components of the device according to the invention.
Figure 8:
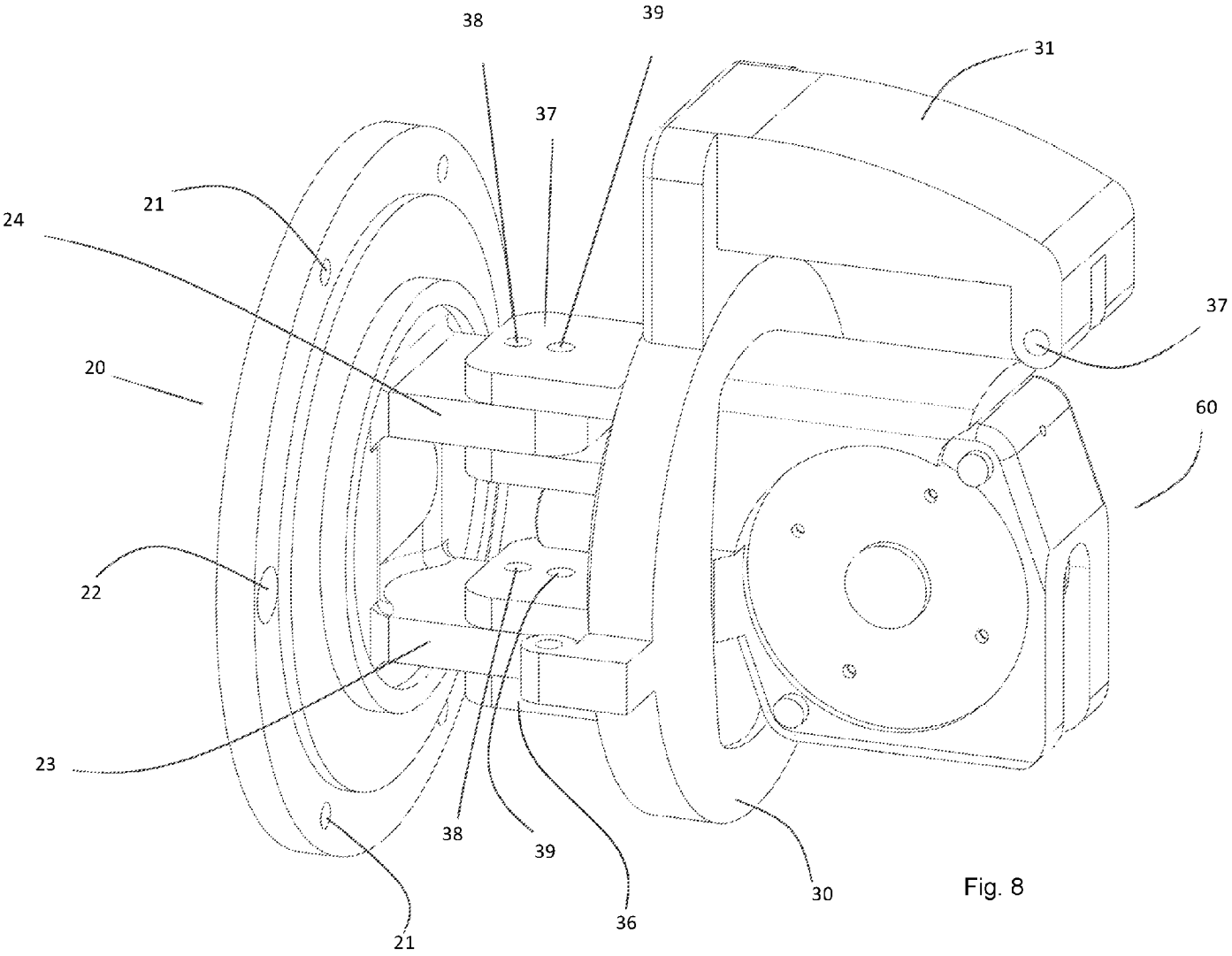
FIG. 8 is a perspective view of the components of the device according to the invention that are close to the vessel.
Figure 9:
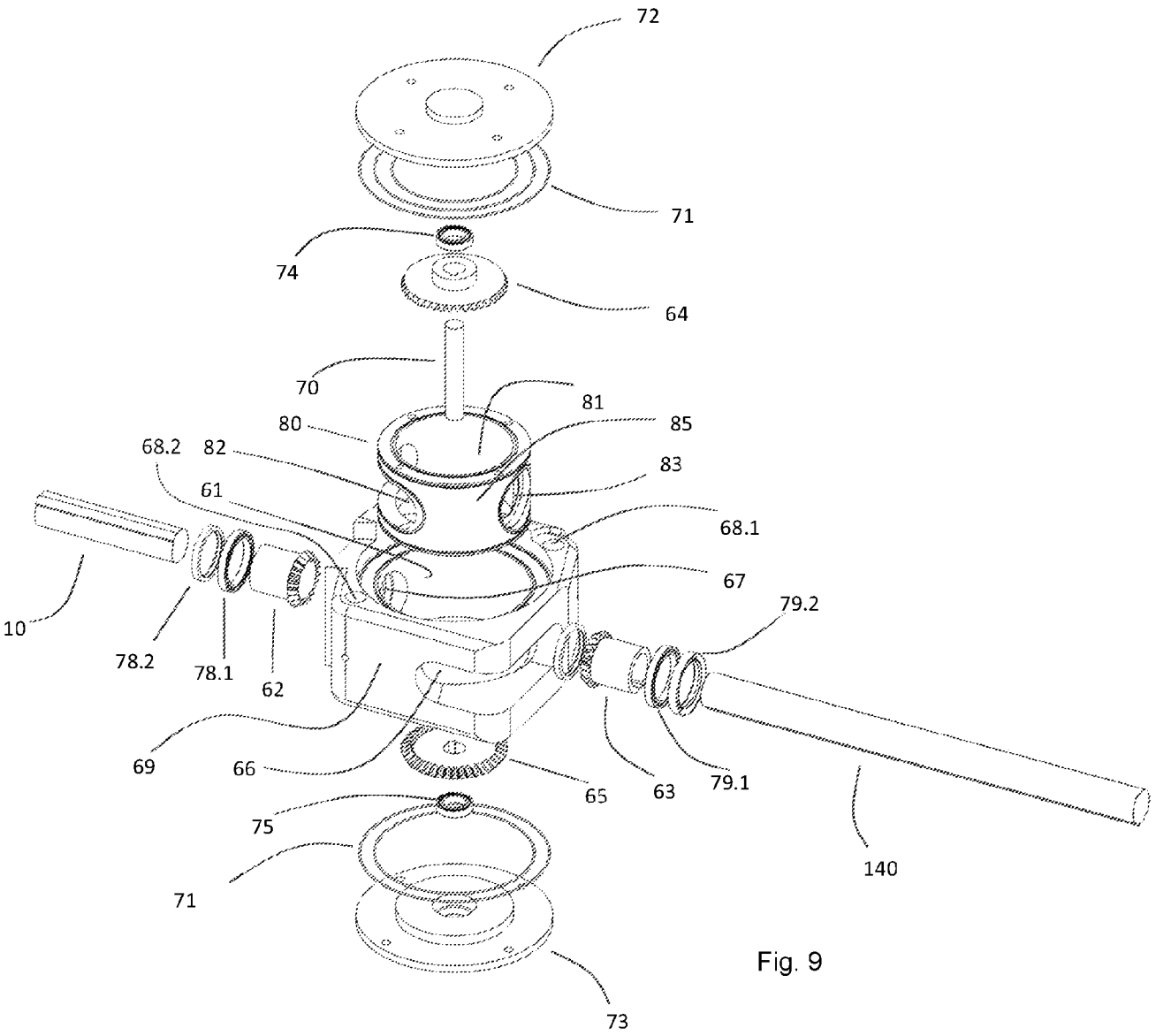
FIG. 9 is a perspective view of the first motion transmission components of the device according to the invention.
Figure 10:
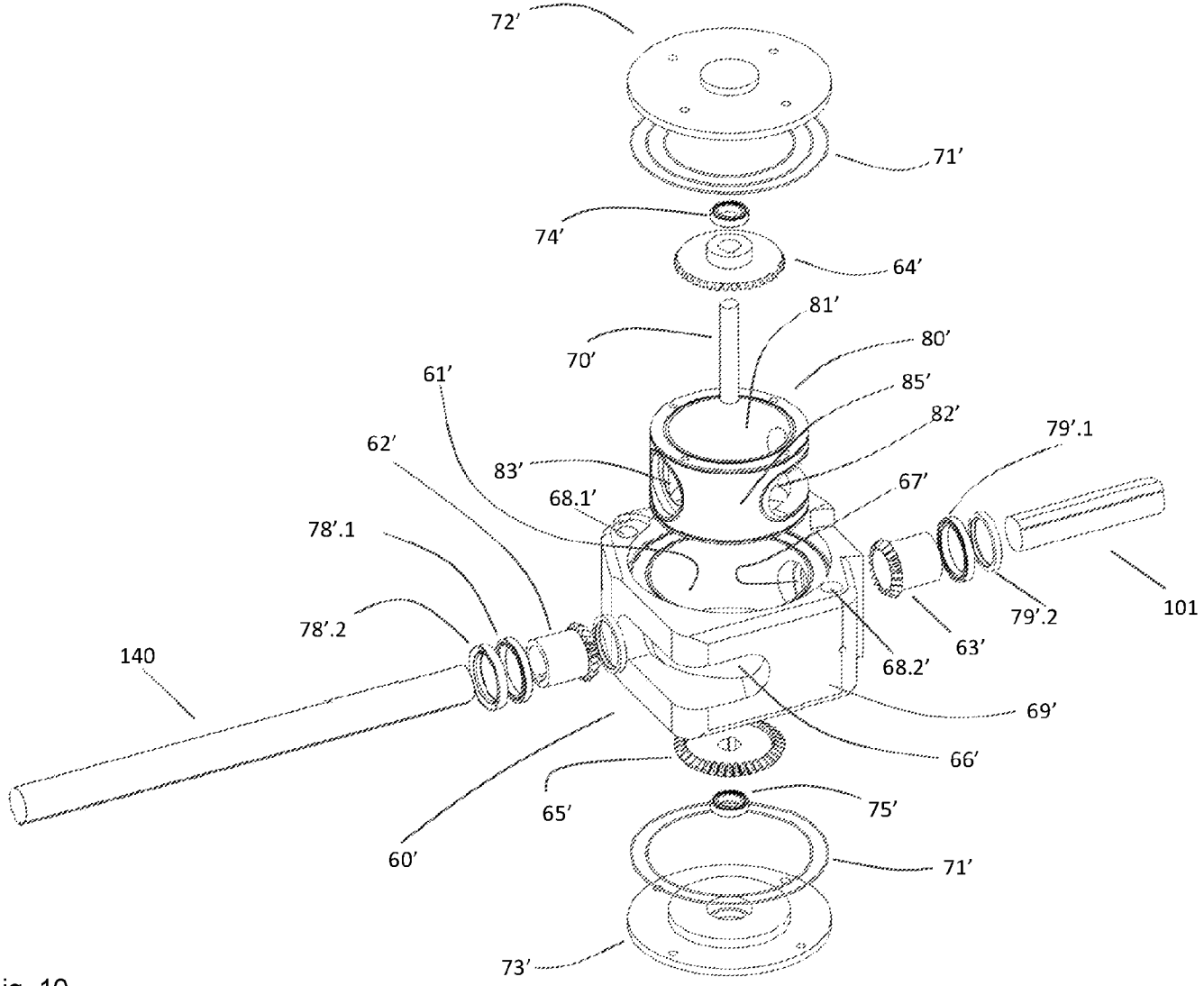
FIG. 10 is a perspective view of the second motion transmission components of the device according to the invention from a different angle.

When the boat has a relatively low cruising speed, the propeller (100) is in a position at which it serves as a conventional shaft drive propeller (the position shown in FIGS. 1 and 3). In this position, the first shaft (10) going out of the motor extends in parallel direction to the water surface while the second shaft (140) extends from the water surface making a downward angle. When the first piston arm (41) is pulled back, the lower housing connection protrusions (59.2) slides in the upper housing connection channels (59.1) and raises the end of the housing (50) where the propeller exists upwards. In the meantime, the upper housing portion (51) rotates around the housing first connecting pin (76) passed through the upper housing first connection holes (57.1) and through the first sleeve first connection hole (68.1); similarly, the lower housing portion (52) rotates around the housing second connecting pin (77) passed through the lower housing first connection holes (58.1) and through the first sleeve second connection hole (68.2).

Since the second shaft (140) is seated in the first ring hole (83), the first ring (80) rotates inside the first sleeve (60). In this case, the first shaft (10) maintains its axial position inside the first ring groove (82) due to the flat ellipse-like form of the latter, without hitting the first ring (80). A similar case is true for the relation of the second shaft (140) with the first sleeve (60). The second shaft (140) rotates relative to the first sleeve (60) without hitting thereto, due to the flat ellipse-like form of the first sleeve groove (66).

In case a third shaft (101) is used, the upper housing portion (51) rotates around the housing first connecting pin (76') passed through the upper housing second connection holes (57.2) and through the second sleeve first connection hole (68'.1); similarly, the lower housing portion (52) rotates around the housing second connecting pin (77') passed through the lower housing second connection holes (58.2) and through the second sleeve second connection hole (68'.2).

In case a third shaft (101) is used, when the first piston arm (41) is pulled back, the upper housing portion (51) rotates around the housing first connecting pin (76') passed through the upper housing second connection holes (57.2) and through the second sleeve first connection hole (68'.1); similarly, the lower housing portion (52) rotates around the housing second connecting pin (77') passed through the lower housing second connection holes (58.2) and through the second sleeve second connection hole (68'.2).

Since the second shaft (140) is seated in the second ring hole (83'), the second ring (80') rotates inside the second sleeve (60'). In this case, the second shaft (140) rotates relative to the second sleeve (60') without hitting thereto, inside the second sleeve groove (66') due to the flat ellipse-like form thereof. A similar case is true for the relation of the third shaft (101) with the second ring (80'). The third shaft (101) maintains its axial position inside the second ring groove (82') due to the flat ellipse-like form of the latter, without hitting the second ring (60).

Figure 2:
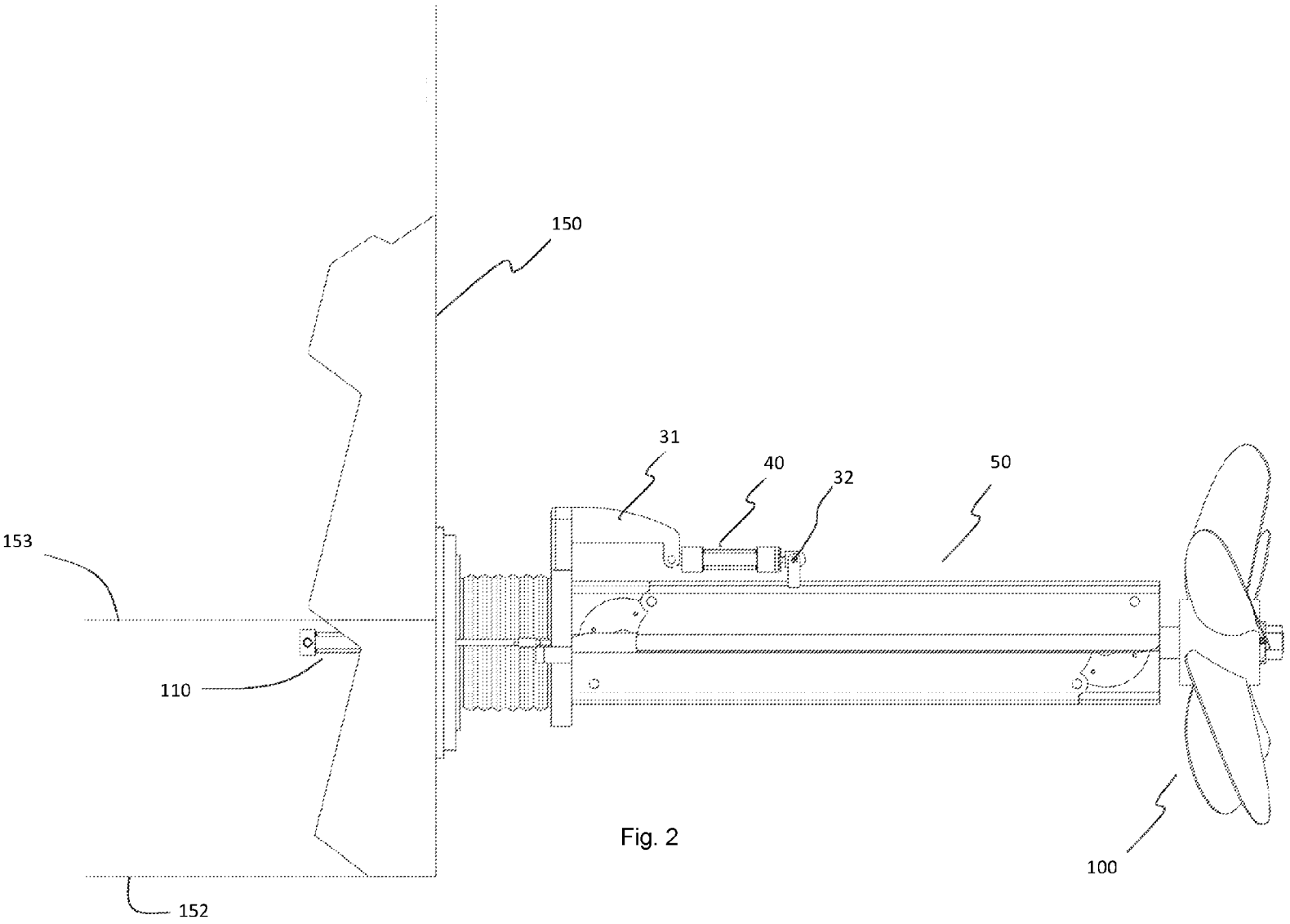
FIG. 2 is a side view of the device according to the invention at a position in water surface.

According to the preferred embodiment of the invention, the device can be stopped at a desired angle between the position in FIG. 1 where it has maximum inclination from the water surface and the extreme position in FIG. 2 where it is parallel to the water surface. On the other hand, since the third shaft (101) is seated in the second sleeve hole (67') such that the axial position thereof cannot be changed, the propeller (100) maintains its position parallel to the water surface during any position of the first piston (40).

The device according to the invention also comprises, for the boats with no rudder, an embodiment that allows the propeller to oscillate horizontally at a certain vertical distance, and thus serving as a steering mechanism. Accordingly, the transom fixing plate (20) comprises a transom fixing plate first lug (23) and a transom fixing plate second lug (24), which extend reciprocally towards the piston support (30). Transom fixing lugs (23,24) are provided with transom fixing plate first pin holes (25) and transom fixing plate second pin holes (26) which are formed adjacently along the width thereof. Similarly, the piston support (30) comprises a piston support first lug pair (36) and a piston support second lug pair (37), which extend reciprocally towards the transom fixing plate (20). Also disposed are piston support first pin holes (38) and piston support second pin holes (39) which are formed adjacently along the width of the pin support lug pairs (36,37).

After the transom fixing plate first lug (23) is introduced between the piston support first lug pair (36) and the transom fixing plate second lug (24) is introduced between the piston support second lug pair (27), transom fixing plate first pin holes (25) and transom fixing plate second pin holes (26) are aligned with piston support first pin holes (38) and piston support second pin holes (39); and the piston support (30) is formed rotatable relative to the transom fixing plate (20) by means of a pin which is passed through the transom fixing plate second pin holes (26) and through the piston support first pin holes (39).

Two reciprocal piston connection holes (22) are formed at the periphery of the transom fixing plate (20). In other words, the imaginary straight line on which the transom fixing plate piston connection holes (22) meet passes from the center of the transom fixing plate (20); and the distance of said imaginary straight line to the transom fixing plate first lug (23) is the same as that to the transom fixing plate second lug (24).

Likewise, a first piston connection protrusion (34) and a second piston connection protrusion (35) are reciprocally formed along the periphery of the piston support (30). That is, the imaginary straight line where the first piston connection protrusion (34) and the second piston connection protrusion (35) meet passes from the center of the piston support (30); and the distance of said imaginary straight line to the piston support first lug pair (36) is the same as that to the piston support second lug pair (37).

As seen in FIGS. 1 and 2, there exists a second piston (110) remaining in the inner portion of the transom (150), as well as a third piston (120) which is opposite thereto. After the second piston arm (112) extending from the second piston (110) and the third piston arm (122) extending from the third piston (120) pass through the reciprocal transom fixing plate piston connection holes (22), they are rotatably communicated to the first piston connection protrusion (35) and to the second piston connection protrusion (36) by means of a pin over the second piston connecting end (111) at the end of the second piston arm and the third piston connecting end (121) at the end of the second piston arm. In case the vessel advances linearly, the second piston arm (112) extends as much as the third piston arm (122), while in case of turning right or left, the second piston arm (112) is moved forward or backward relative to the third piston arm (122) and the vessel is thus oriented.

For the boats having a rudder mechanism, another pin is passed through the transom fixing plate first pin holes (25) and piston support first pin holes (38); hence, rotatability of the piston support (30) relative to the transom fixing plate (20) is eliminated.

The invention claimed is:

1. A propeller position changing device comprising:

a first shaft (10) communicating with a motor from a first end thereof, a second shaft (140) communicating with a second end of the first shaft (10) wherein the second shaft is rotatable about the axis of the first shaft (10) or an axis separate from axis of the first shaft (10), a motion transmission means communicating the first shaft (10) to the second shaft (140), a first piston (40) rotating the second shaft (140) relative to the first shaft (10), and a propeller (100) communicating with the second shaft (140) from a second end thereof, further including:

a first conical gear (62) provided to the second end of the first shaft (10), a second conical gear (63) provided to the first end of the second shaft (140), a third conical gear (64) transmitting motion between said conical gears (62, 63), a first sleeve (60) comprising a first sleeve groove (66) through which the second shaft (140) is moved for making a relative motion thereof, a first sleeve hole (67) for rotatable communication of the first shaft (10), a first ring (80) receiving the first conical gear (62), the second conical gear (63) and the third conical gear (64), and comprising a first ring groove (82) through which the first shaft (10) is moved for making a relative motion thereof, and a first ring hole (83) for rotatable communication of the second shaft (140).

2. The propeller position changing device of claim 1, further comprising a third shaft (101) placed between said propeller (100) and second shaft (140), a fifth conical gear (62') provided to both ends of the second shaft (101), a sixth conical gear (63') provided to the first end of the third shaft (101), a seventh conical gear (64') transmitting motion between said conical gears (62', 63'), a second sleeve (60') comprising a second sleeve groove (66') through which the second shaft (140) is moved for making a relative motion thereof, a second sleeve hole (67') for rotatable communication of the third shaft (101), a second ring (80) receiving said fifth conical gear (62'), sixth conical gear (63') and the seventh conical gear (64'), and comprising a second ring groove (82') through which the third shaft (101) is moved for making a relative motion thereof, a second ring hole (83') for rotatable communication of the second shaft (140).

3. The propeller position changing device of claim 2, wherein the first sleeve groove (66) is positioned in a way to correspond to the first ring hole (83), and the first sleeve hole (67) to the first ring groove (82); and that the second sleeve groove (66') is positioned in a way to correspond to the second ring hole (83'), and the second sleeve hole (67') to the second ring groove (82').

4. The propeller position changing device of claim 3, further comprising a housing (50) which rotatably communicates, from one end, with said first sleeve (60), and from the other, with said second sleeve (60') and which accommodates said first sleeve (60) and second sleeve (60').

5. The propeller position changing device of claim 4, wherein said housing (50) comprises an upper housing portion (51) having connection channels (59.1) and a lower housing portion (52) having connection protrusions (59.2) introduced into said connection channels (59.1) for sliding thereof relative to the upper housing portion (51).

6. The propeller position changing device of claim 4, wherein the first piston (40) communicates, from one end, with said upper housing portion (51), and from the other, with a piston support (30).

7. The propeller position changing device of claim 6, wherein said piston support (30) comprises a piston support first lug pair (36) and a piston support second lug pair (37).

8. The propeller position changing device of claim 7, further including a transom fixing plate (20) which comprises a transom fixing plate first lug (23) in rotatable communication with the piston support first lug pair (36) and a transom fixing plate second lug (24) in rotatable communication with the piston support second lug pair (37).

9. The propeller position changing device of claim 8, wherein said piston support (30) comprises a first piston connection protrusion (34) communicating with a second piston (110) and a second piston connection protrusion (35) communicating with a third piston (120).

10. The propeller position changing device of claim 9, wherein a cylindrical bellows (130) is disposed between the transom fixing plate (20) and the piston support (30).

11. A vessel of a floating type having an inboard motor, further including the propeller position changing device according to claim 9.

* * * * *